US006662517B1

(12) United States Patent
Thompson

(10) Patent No.: US 6,662,517 B1
(45) Date of Patent: Dec. 16, 2003

(54) RETROFIT HURRICANE-EARTHQUAKE CLIP

(76) Inventor: Thomas C. Thompson, 92-543 Kokole Pl., Makakilo, HI (US) 96707

( * ) Notice: Subject to any disclaimer, the term of this patent is extended or adjusted under 35 U.S.C. 154(b) by 79 days.

(21) Appl. No.: 09/880,239

(22) Filed: Jun. 12, 2001

Related U.S. Application Data

(63) Continuation-in-part of application No. 09/516,655, filed on Mar. 1, 2000.

(51) Int. Cl.[7] ..... E04B 1/38; E04C 5/00
(52) U.S. Cl. ..... 52/714; 52/712; 52/715
(58) Field of Search ..... 52/712, 714, 715

(56) References Cited

U.S. PATENT DOCUMENTS

| | | | | |
|---|---|---|---|---|
| 2,321,221 A | | 6/1943 | Linehan | |
| 2,321,671 A | * | 6/1943 | Grotta | 72/46 |
| 2,413,362 A | | 12/1946 | Maxwell et al. | |
| 3,256,030 A | | 6/1966 | Banse | |
| 4,410,294 A | | 10/1983 | Gilb et al. | |
| 4,572,695 A | | 2/1986 | Gilb | |
| 4,714,372 A | | 12/1987 | Commins | |
| 5,109,646 A | | 5/1992 | Colonias et al. | |
| 5,230,198 A | | 7/1993 | Callies | |
| 5,311,708 A | | 5/1994 | Frye | |
| 5,335,469 A | | 8/1994 | Stuart | |
| 5,437,132 A | | 8/1995 | Meyers | |
| 5,560,156 A | | 10/1996 | McDonald | |
| 5,603,580 A | * | 2/1997 | Leek et al. | 403/232.1 |
| 5,640,822 A | | 6/1997 | Haswell | |
| 5,732,524 A | | 3/1998 | Kalker et al. | |
| 6,094,880 A | | 8/2000 | Thompson | |
| 6,101,780 A | | 8/2000 | Kreidt | |
| 6,295,781 B1 | * | 10/2001 | Thompson | 52/712 |

OTHER PUBLICATIONS

Simpson Wood Contruction Connectors Jan. 1, 2001 pp. 128–129.
Simpson Light Gauge Steel Connectors May 1, 1998 pp. 13–14.
Prescriptive Method for Residential Cold–Formal Steel Framing, 2nd Edition pp. 70–89.

* cited by examiner

*Primary Examiner*—Carl D. Friedman
*Assistant Examiner*—Steve Varner

(57) ABSTRACT

A hurricane and earthquake clip for connecting a roof to a wall on new construction and existing houses. The connector can tie together the outside wall sheathing, top plate, roof rafter or roof truss, and roof sheathing. The metal connector comprises a base member, rafter tabs, spacer webs, sheathing tabs, and gussets. The wide base member holds the wall sheathing securely to the wall and prevents bowing out and lateral movements. The rafter tabs and gussets attach to the roof rafter or roof truss. Parallel bends on the spacer allow the sheathing tab to be attached to different roof slopes. The connector can also be made into left's and right's for attaching onto odd size structural members. The connector helps prevent wind and seismic damage to a house.

17 Claims, 12 Drawing Sheets

RETROFIT HURRICANE-EARTHQUAKE CLIP

This application is a continuation-in-part of Ser. No. 09/516,655, filed Mar. 1, 2000.

BACKGROUND

1. Field of Invention

This invention is a continuation-in-part of Ser. No. 09/516,655, filed Mar. 7, 2000 and relates to an innovative connector that permanently connects the roof to the outside wall to create buildings that are stronger and more resistant to hurricanes and earthquakes.

2. Description of Prior Art

BACKGROUND

Recent studies of hurricane damage on wood-frame buildings indicate that extensive damage was generated to a house by strong winds, when the roof rafters or roof trusses twisted or were pulled up from the outside wall, along with the roof sheathing.

Roof sheathing ties all the rafters or purlins together on a wood frame house, and the roof sheathing ties all the roof trusses together when a masonry or wood-frame house is constructed with trusses. If the rafters or trusses rack or twist from the wind forces, the roof sheathing can detach from the roof allowing rain to enter the house.

Sheathing that is tightly secured to the rafters or trusses and subsequently fastened to the walls, helps transfer uplifting forces to the walls and henceforth to the foundation. The leading edge of a roof is the weakest point of sheathing uplift during strong winds, and this invention helps prevent any roof uplift. Adding more nails to the sheathing just splits the sheathing and the underlying structural member making the connection weaker.

Failure of the outside wall sheathing is also common during hurricanes, because of inadequate fastening of the wall sheathing to the underlying structural members. This invention helps prevent the wall sheathing from splitting, racking, and detaching from the wall. The extreme negative pressure of a hurricane blows out the sheathing from walls, but this invention holds the sheathing tight to the walls, as sheet metal joints perform better than nailed joints in high winds and during seismic activity. Adding more nails just splits the sheathing and underlying structural members.

Hurricanes

Studies of damage after Hurricane Andrew show several problems with the attachment of roof rafters, roof trusses, roof sheathing, and wall sheathing that this invention solves.

Roof overhangs act like wings, creating huge uplifting forces during strong winds. This uplift tears apart the rafters that are toe-nailed to the header or top plate. The uplift can also twist rafters and roof trusses weakening the toenailed connections and causing detachment of the structural members and roof sheathing.

The one thing that ties together the top plate, studs, and sill plate is the outside sheathing. This invention effectively ties together the rafter, top plate, and outside wall sheathing to form a continuous load-path to the sill plate. Attaching my invention to the rafter and top plate junction puts the nails perpendicular to the uplifting force and would require shearing the nails in order to lift the rafter or truss.

On newer stud-wall construction, we have seen that studs rarely line up directly under the rafters. We saw houses where the walls have studs 16-inches on center, constructed with a roof that had rafters 24-inches on center. This means the only rafter and stud that will line up to form a continuous load-path is every fourth stud or every other rafter. The odds are low that they will exactly line up.

Another problem with home construction is on misinstallation of prior art hurricane clips that are made for new construction and covered by wall sheathing. After Hurricane Andrew, there were many examples of careless and inferior attachment of hurricane clips or they were entirely missing. One company has visited new construction sites and documented many examples of shoddy and incorrect application of their products.

To achieve a continuous load-path on existing houses the outside sheathing must be taken into account. The most important tie in an existing house is between the rafter and top plate or roof truss and top plate. Any uplifting wind force on the roof must be transferred to the walls. In tropical climates, the roof purlin, an intermediate structural member, may separate from the rafter along with the roof sheathing.

My invention effectively ties together the roof, rafter or roof truss, top plate, and outside sheathing (and indirectly, the wall studs) to form the most practical and economical continuous load path from the roof to the foundation.

Earthquakes

During an earthquake, the wall and roof diaphragms undergo shearing and bending. Because of the difference in weight, a roof can move at different speeds than the walls. The shear forces from the roof boundary members are transferred to the top of the shear wall by way of toenails to the top plate. To withstand and transfer the shear loads, the connection between the roof and wall must be stronger than toenailing.

The outside sheathing provides lateral stability to the walls, preventing racking. The sheathing also absorbs and transfers earthquake forces by becoming a shear wall.

An earthquake can send motion into a house and separate the sheathing from the walls. The sheathing can come loose from the walls by the nails popping out or the plywood splitting away from the nails driven on it's edge. This invention helps prevent the outside sheathing from pulling away from the wall during earth movements.

Steel connectors, between different components of a wood-frame buildings superstructure, provide continuity so that the building will move as a unit in response to seismic activity (Yanev, 1974). This invention ties the walls securely to the roof, so the house will move as one unit.

This invention ties the roof sheathing to the rafter and top plate. This invention can help transfer loads acting on the roof to the walls and foundation. It can also help transfer loads acting on the walls to the roof, which can help absorb and dissipate the loads to different walls.

Prior Art

A number of connectors have been developed to tie together the structural members of a house under construction. Up until this invention, nobody had seen how to make a retrofit connector that could tie sheathing to the underlying structural members and connect to the side or "meat" of a rafter or roof truss without having material hanging down.

The leading manufacturer of wood construction connectors, the Simpson Strong-tie Company, has a variety of connectors for use in new construction that tie the rafter to the top plate including: H1, H2, H2.5, H3, H4, H5, H6, H10, H9, H7, H15, H10-2, and HS24. None are shown tying the wall sheathing to the wall, or the roof sheathing to the rafter and top plate.

There are a number of ties that fasten the rafter to the top plate while a house is being constructed including: Knoth U.S. Pat. No. 5,561,949, McDonald U.S. Pat. No. 5,560,156, Colonias U.S. Pat. No. 5,380,115, Stuart U.S. Pat. No. 5,335,469, Callies U.S. Pat. No. 5,230,198, Colonias et al U.S. Pat. No. 5,109,646, Commins U.S. Pat. No. 4,714,372, Gilb U.S. Pat. No. 4,572,695, Gilb et al U.S. Pat. No. 4,410,294, and Maxwell et al U.S. Pat. No. 2,413,362.

These are good inventions, but they are difficult to retrofit onto existing houses without demolition of existing parts on a house. None were designed or patented to be retrofit on to an existing house, hold down roof sheathing, or work on roofs of different pitches.

The prior art hurricane clips provide little lateral strength, even when using a left and right. The prior art doesn't tie the outside sheathing to the underlying top plate and roof rafter, so they cannot prevent the outside sheathing from being sucked off during the extreme negative pressure of a hurricane.

The prior art inventions do not prevent the outside sheathing from splintering and disconnecting during earth tremors. They do not have multiple uses such as tying the roof sheathing to the rafter and top plate at the top of the wall, which is one the weakest points in a wood-frame house during a hurricane or tornado, especially on weak toe-nailed connections.

Frye's anchor system, U.S. Pat. No. 5,311,708, is patented as a retrofit, but it does not tie the rafter to the top plate, and it ties into the weakest thin edge of the rafter while splitting it with bolts. Frye's 708 also provides no lateral support against side movements.

Netek's reinforcing tie, U.S. Pat. No. 5,257,483, is patented as a retrofit, but it is temporary, and like Frye's, ties into an even weaker thin edge of the end of the rafter. Netek's 483 also provides no lateral support against side movements.

There are several retrofit apparatus for securing roofs using cables. Adams U.S. Pat. No. 5,570,545 and Winger U.S. Pat. No. 5,319,896 are both temporary, meaning a homeowner must be home to deploy and anchor the ephemeral cables. The anchors can only be as secure as the nearby soil and the cables do not prevent the walls from bowing or blowing out.

There are a number of joist hangers that fasten to a joist and vertical member while a house is being constructed including: Colonias et al U.S. Pat. No. 5,104,252 and Gilb U.S. Pat. No. 4,480,941. These are good inventions, but they are difficult to retrofit onto existing houses.

Joist hangers have a small ledge that supports all the weight from the joist beam. They hang the weight from the edge, rather than supporting the weight on top of the edge. They are also thin and parallel to the long dimension of the joist beam, concentrating all that carrying weight onto a horizontal thin-section of the vertical member.

Gilb's complicated hanger, U.S. Pat. No. 4,261,155, is strong, but cannot be retrofit on to a house.

Prior art connectors relied on angled nailing, to provide lateral support, which is complex to manufacture, and very difficult to install on a completed house.

SUMMARY

The present invention is a sheet metal connector that can be installed on new construction or as a retrofit for existing buildings.

The connector can positively join multiple wood members on a building, such as the roof sheathing, roof rafter, top plate, and outside wall sheathing. During a hurricane, it prevents the roof sheathing and the roof rafter from disconnecting from the outside wall sheathing, and underlying top plate by uplifting forces.

The gale clip prevents the outside wall sheathing from detaching or bowing out from negative pressure extremes generated by a hurricane. It also prevents the wall from bowing in when on the windward side of the hurricane.

The gale clip prevents detachment and sliding of the outside wall sheathing from lateral forces during an earthquake. This clip makes the outside wall sheathing into an extremely stable shear wall; and ties the top plate and roof rafter securely to this shear wall making it resistant to most earth tremors.

The gale clip prevents detachment and movement of the roof sheathing and roofing material during wind or seismic forces. This invention strengthens the weakest connection on a house, the roof to outside wall attachment. The squall clip is approximately one-half of a gale clip, for use on doubled-up rafters and roof trusses, or for use on beams using non-standard dimensions.

OBJECTS AND ADVANTAGES

Accordingly, several objects and advantages of my invention are that it helps secure the roof and wall of a building to make the building a solid unit and preventing it from being destroyed by hurricanes and earthquakes.

This invention helps prevent the roof from being blown off the walls of an existing building. It keeps the roof sheathing connected to the rafters or roof trusses, and each tightly secured to the outside sheathing and underlying top plate.

This invention helps prevent the roof rafters and roof trusses from twisting during strong winds, thereby preventing detaching of the roof material and underlying roof sheathing. It stiffens the edge of the roof and the top of the wall, helping to transfer and dissipate lateral loads to the whole roof and walls.

This invention helps prevent the wall sheathing of a building from detaching from the wall studs during an earthquake. It helps make the outside wall into a stable shear-wall, transferring shear forces into the foundation and ground.

One object of this invention is to make each outside wall on a house into a shear-wall, that is, able to transfer forces without breaking or disconnecting. By tying the outside sheathing securely to the top plate, rafter or roof truss, and roof sheathing, the plywood can reliably transfer and dissipate shear, lateral, and uplift forces.

During an earthquake or a hurricane, a building with this invention will be a sturdy unit, resisting, absorbing and transferring destructive forces.

Many older homes were constructed with the best materials by competent carpenters, but used the time-honored method of connecting the rafter to the top plate with nails driven into the edge of the rafter. This weak connection, called toe-nailing, is still in use today to hold roof trusses to the top plate. It is a weak connection because uplift forces are in the same direction of nail travel. This invention puts the nails in shear.

Even if prior art hurricane clips were used in construction of a house, the homeowner can't tell, and those clips don't hold the outside wall sheathing to the wall. A homeowner can tell if the present invention was placed on his home.

Mounted on the roof rafter or roof truss, my invention resists twisting, racking, and thrusting. Mounted on the top plate and wall sheathing, my invention prevents the wall sheathing from being blown off or sucked out by the extreme negative pressure of a hurricane. Mounted on the roof sheathing, my invention prevents uplift, thrusting, and racking.

During an earthquake, when my clips are mounted on the roof and walls, they will make each member into a shear wall. The secured plywood will absorb and dissipate earth movements, without becoming detached from the underlying structural members. It will also prevent the sheathing from sliding past each other.

This would improve the house beyond existing building codes, as sheet metal joints have been proven to perform better than nailed joints during hurricanes and earthquakes.

Another object of this invention is the large surface area. This area prevents the outside sheathing from splitting during hurricanes or earthquakes. The large surface area provides more strength in the connecting or hold-down process, and helps prevent the wall sheathing from bowing or blowing out.

Yet another advantage of this invention is during earthquakes, nails can sometimes bend with the movements of the house, but screws often break. This invention absorbs and transmits most of the forces during an earthquake and hurricane so nails, bolts, and/or screws can be used as fasteners.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the invention to fail.

Still another advantage is that with the roof rafters and roof trusses better able to resist twisting, roof sheathing will stay firmly attached and roofing material will now have a better chance of staying on during strong winds and earth movements. In addition, with the sheathing now firmly connected, new materials may be attached to the roof, such as solar electric panels, without fear of them being blown off.

In areas with brush or forest fire danger, fire-proof material or heavy material, such as tile, stone or metal, can now be applied to the roof with less danger of being blown or shaken off during earth tremors or high winds. Fire-proof materials such as stucco or brick veneer can be applied to the wall sheathing with less chance of being shaken off during earth movements.

Earth tremors and hurricanes always destroy the weakest parts of a house. By making each envelope of a house, the vertical walls and roof envelope into a strong unit, there will be less damage.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical.

Another advantage is that this invention surrounds the rafter for incredible strength. It also forms an upside-down J-shape from the side, which adds even more strength.

Still another advantage is the invention will tie into existing blocking between rafters for added strength. On houses build without blocking, this invention will prevent twisting of the rafter, which is what blocking does.

A further object is that this invention can be used on many different width of rafters or roof trusses such as 2×4, 2×6, 2×8 or even wood or metal I-beams, and engineered wood, plastic, and metal beams. There may be insurance discounts for homeowners who have this invention installed on their houses.

As a retrofit, a handy homeowner can install this invention, or have it installed. The homeowner can easily see that the home is protected instead of wondering if hurricane clips were installed correctly during construction, or installed at all.

When used on new construction, this invention could be covered over with sheathing or insulated sheathing.

Traditional toe-nailing of the rafter is at the bird's-mouth, a notch cut into the rafter where it rests on the top plate. By cutting out material from the rafter, a bird's-mouth weakens the rafter. Toe-nailing only two nails from either side grasps only a small edge of the rafter, and the nail only extends into the top part of the top plate.

This new retrofit invention strengthens the rafter to top plate connection by vastly increasing the spacing and amount of nails in the thickest part or "meat" of the rafter. This clip also strengthens the bird's mouth by wrapping on either side of the rafter and keeping it from splitting along the long measure.

As a retrofit, an insurance agent can observe that the home is protected and give appropriate discounts. Perspective home buyers can perceive that the building is protected, so the seller has a good selling point and can ask for a better price.

Since these clips can be retrofit or used on new construction they are more versatile than prior hurricane clips that could only be used on new construction.

Another advantage is with the top webs angled away from vertical, they form an upside-down flying buttress. This tremendously increases resistance to outward thrusts. This makes the roof much stronger and able to resist more weight such as thick snow, ice, or volcanic ash, and heavy roofing material such as tile, insulated roofing, solar collectors, and satellite dishes.

This invention takes the place of a left and right prior art hurricane clip, thus cost and installation time is substantially reduced. Installation can be accomplished with a power nailer or powered screw gun.

The left and right rafter tabs, and the angled sheathing tabs combine to cradle the rafter, significantly increasing lateral strength over prior hurricane clips. The angled sheathing tab forms a strong J-shape in profile, which is unique and prevents lateral, trusting, and uplift forces.

Since this invention cradles the rafter or roof truss on the bottom, left, right, and top side, and has a wide base anchored to the outside wall, torsional twisting of the rafter is significantly reduced over prior art hurricane clips, as is cross-grain splitting.

Since the left and right rafter tabs, and the angled sheathing tabs combine to significantly increase lateral stiffness, no part of the invention hangs below the rafter, hence it is invisible from the side. Architects and homeowners approve that this retrofit hurricane clip is concealed.

The left and right tabs, that are installed on opposite sides of the rafter have offset nail holes. Nails driven into the rafter will be offset from each other lessening wood splitting and vastly increasing holding power.

This invention can hold down roofing material and roof sheathing, providing great rigidity to the entire house. This makes the house significantly more resistant to strong winds and earth tremors.

In tropical climates, where hurricanes are common, roof purlins are used to support the roof sheathing, usually corrugated metal roofing, which is too thin to fit between standard rafters. This invention can hold down a roof purlin and corrugated metal roofing. It can also hold down curved roof tiles, shakes, and shingles.

Edges of the clip are slightly rounded for strength, ease of handling, and avoiding stress fracturing associated with sharp corners.

These and other objectives of the invention are achieved by simple and economical connectors that allow a builder or home owner to quickly and easily secure the weakest parts of a building against earth tremors and high winds.

The invention is designed for nesting during manufacture, thus saving material. The invention can also be primed and painted at the factory. The same die can be used to make one-piece or two- pieces to allow for various width rafters.

The double bends of the sheathing tab allow the invention to fit on roofs various pitch roofs, while using a minimum amount of material. The double bends allow the roof sheathing bolts to be positioned further away from the outside wall, allowing for easier installation. The angle of the sheathing tabs allow for the nails to be spaced away from each other, with less chance of splitting the wood.

Standard washers can be used on top of the roof to tie into the present invention. A unique, strong, plate is shown in the drawings and can be used to make the roof connection tremendously strong.

Advantages of each will be discussed in the description. Further objects and advantages of my invention will become apparent from a consideration of the drawings and ensuing description.

REFERENCE NUMERALS IN DRAWINGS

Figure 1:
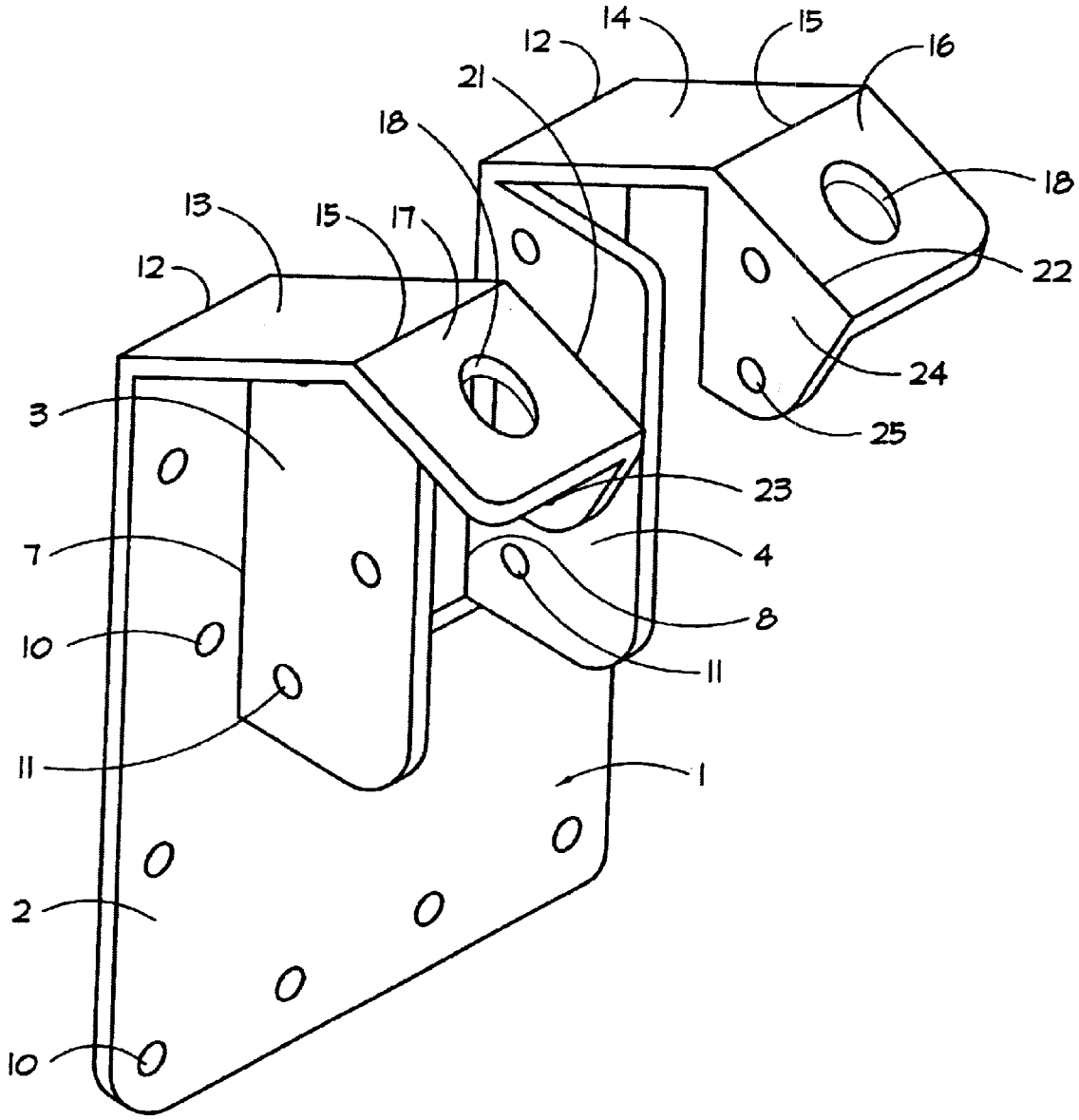
FIG. 1 is a perspective view of a gale clip.

| Reference Numerals in Drawings |
|---|
| 1. Gale clip |
| 2. Base plate |
| 3. Left rafter tab |
| 4. Right rafter tab |
| 5. Left rafter cut |
| 6. Right rafter cut |
| 7. Left rafter bend |
| 8. Right rafter bend |
| 9. Center cut |
| 10. Base nail holes |
| 11. Rafter holes |
| 12. Transition bend |
| 13. Left spacer |
| 14. Right spacer |
| 15. Sheathing bend |
| 16. Right sheathing tab |
| 17. Left sheathing tab |
| 18. Bolt holes |
| 19. Left spacer cut |
| 20. Right spacer cut |
| 21. Left gusset bend |
| 22. Right gusset bend |
| 23. Left gusset |
| 24. Right gusset |
| 25. Nail holes |
| 26. Lower gusset cut |
| 27. Upper gusset cut |
| 28. Alignment marks |
| 29. Roof plate |
| 30. Bolt |
| 31. Nut |
| 32. Square hole |
| 33. Right squall clip |
| 34. Base plate |
| 35. Rafter bend |
| 36. Rafter tab |
| 37. Transition bend |
| 38. Nail holes |
| 39. Nail holes |
| 40. Spacer web |
| 41. Sheathing bend |
| 42. Bolt hole |
| 43. Gusset bend |
| 44. Gusset |
| 45. Nail holes |
| 46. Sheathing tab |
| 47. Angle (Prior Art) |
| 48. Left squall clip |
| 49. Plate (Prior Art) |
| 50. Slotted hole |
| B. Blocking |
| M. Roofing material |
| R. Rafter or roof truss |
| S. Roof sheathing |
| T. Top plate |
| W. Wall sheathing |
| D. Wall stud |
| C. Chord |
| J. Joist |

DESCRIPTION

The present invention is a sheet metal connector that can be installed on new construction or as a retrofit for existing buildings.

The connector can positively join wood members on a building, such as the roofing material M, roof sheathing S, roof rafter R, top plate T, and outside wall sheathing W. During a hurricane, it prevents the roof sheathing S and the roof rafter R from disconnecting from the outside wall sheathing W, and underlying top plate T by uplifting forces.

Refer now to FIG. 1 which shows a perspective view of a gale clip l. The gale clip 1 is comprised of a flat base plate 2 with multiple nail holes 10. Vertical, parallel, right-angle bends, near the middle of the top section of the base plate 2, form a left rafter bend 7 bend and right rafter bend 8. These bends are bent from the base plate 2 to form a left rafter tab 3 and right rafter tab 4 respectively.

On the top of the base plate 2, perpendicular to the rafter bends 7 and 8, a horizontal transition bend 12 is at an acute angle from vertical. It forms a left spacer web 13 and right spacer web 14 adjacent to the rafter tabs 3 and 4. Both spacer webs 13 and 14 are generally parallel to each other.

On both spacer webs 13 and 14, opposite the transition bend 12, a shallow bend forms the sheathing bend 15. Attached to both spacer webs 13 and 14, at the sheathing bend, are sheathing tabs. The left sheathing tab 17 and right sheathing tab 16 are generally parallel, spaced away from the vertical base plate 2, and bent away from the horizontal position. Both sheathing tabs 16 and 17 have bolt holes 18.

On the inner edges of the left sheathing tab 17 and right sheathing tab 16 are right angle bends. The left gusset bend 21 forms a left gusset 23, from the left sheathing, tab 17. The right gusset bend 22 forms a right gusset 24, from the right sheathing tab 16. The left gusset 23 is parallel to the left rafter tab 3 and is the same plane. The right gusset 24 is parallel to the right rafter tab 4 and is in the same plane. Both gussets 23 and 24 have nail holes 25.

The gale clip 1 prevents the outside wall sheathing W from detaching or bowing out from negative pressure extremes generated by a hurricane. It also prevents the wall from bowing in when on the windward side of the hurricane.

The gale clip 1 prevents detachment and sliding of the outside wall sheathing W from lateral forces during an earthquake. This clip makes the outside wall sheathing W into an extremely stable shear wall; and ties the top plate T and roof rafter R securely to this shear wall making it resistant to most earth tremors.

The gale clip 1 prevents detachment and movement of the roof sheathing S and roofing material M during wind or seismic forces. This invention strengthens the weakest connection on a house, the roof to outside wall attachment.

Figure 2:
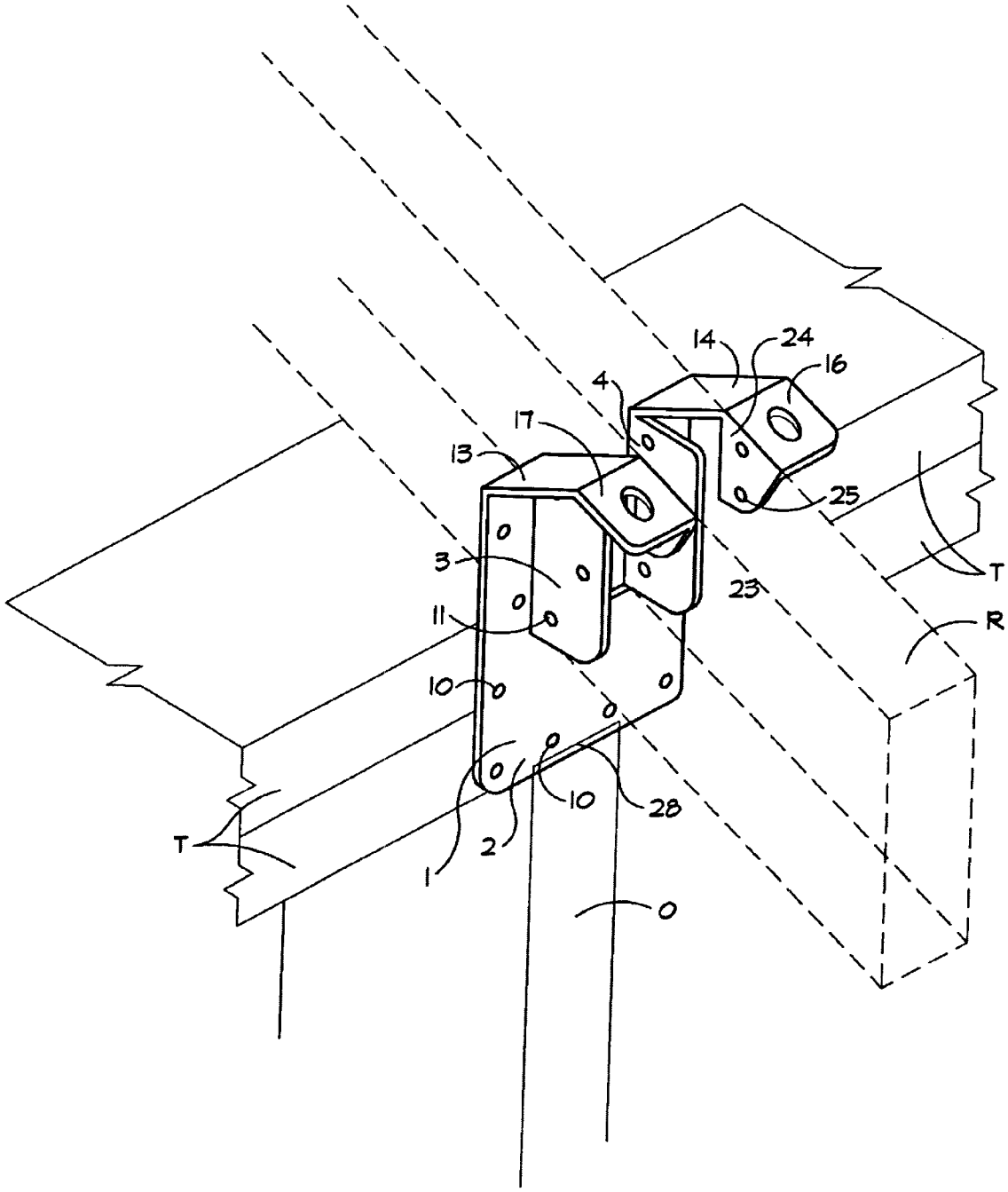
FIG. 2 is a perspective view of a gale clip installed on new construction.

Refer now to FIG. 2 which shows a perspective view of a gale clip 1 installed on new construction. A rafter R is to be installed on a top plate T, directly over a wall stud D. In this example, the alignment marks 28 are placed over the thickness of the wall stud D, and then raised up so the lowest nail holes 10 are placed over the lower plate of the top plate T. Fasteners are driven through nail holes 10, on the base plate 2, into both plates of the top plate T.

When the rafters R or roof trusses R are made or delivered, then they can be set between the left rafter tab 3 and the right rafter tab 4. FIG. 2 shows a rafter R in phantom lines so the right side of the gale clip 1 is visible. When the rafter R is in position, fasteners can be driven through the nail holes 11, on the rafter tabs 3 and 4, and into the rafter R.

With the rafter tabs 3 and 4 attached to the rafter R, the left gusset 23 and right gusset 24 can be attached to the rafter R. In FIG. 2, the left gusset 23 is mostly hidden by the left sheathing tab 17. Fasteners can be driven through the nail holes 25, on the gussets 23 and 24, into the rafter R.

When the rafter tabs 3 and 4 and the gussets 23 and 24 are fastened to the rafter R, there are multiple attaching components on each side of the rafter R and gale clip 1. Prior art hurricane clips have only one attaching component on each side of a rafter. By having multiple attaching components on each roof structural members, loads on the building can be increased dramatically.

Previously, sheathing had to be immediately installed to a roof truss in order to prevent them from racking and collapsing during strong winds. The gale clip 1 prevents a roof truss from twisting or racking before sheathing is installed. When attached to a rafter or roof truss, the left rafter tab 3, base plate 2, left spacer web 13, left sheathing tab 17, and left gusset 23 form a braced, upside-down J-shape. The equivalent right-side members also do the same on the right side. This unique J-shape has extra material and surface area, and an open-box shape near the top edge of the rafter/roof truss that helps prevent twisting and racking of the attached roof truss.

The gale clip 1 can also be installed the same time as a rafter is installed. The rafter can be mounted in the correct position, and a gale clip 1 installed to the rafter and top plate. The gale clip 1 can also be installed after the rafter is in position.

Figure 3:
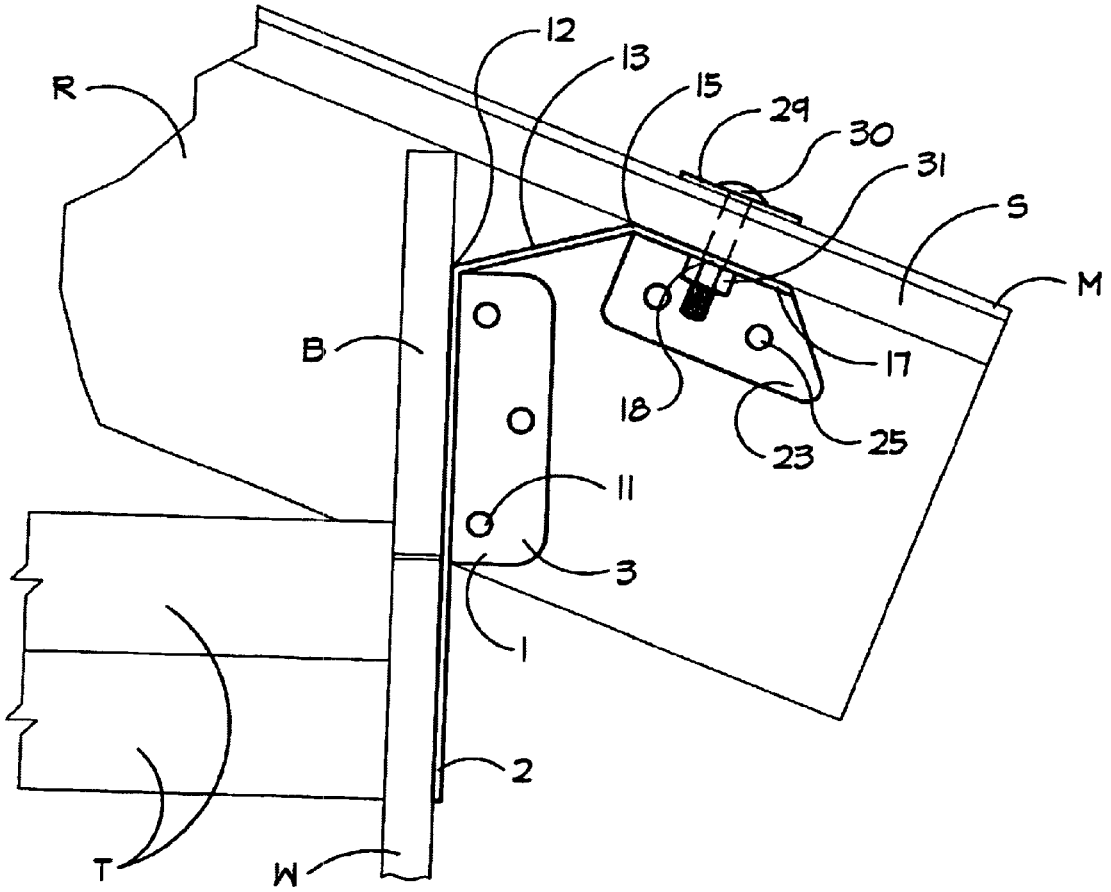
FIG. 3 is a side view of a gale clip installed as a retrofit an existing house.

Refer now to FIG. 3 which shows a side view of a gale clip 1 installed as a retrofit on an existing house. This view shows the left side of a gale clip 1, but the right side is similar. The gale clip 1 is installed as a retrofit by sliding the left rafter tab 3, left spacer web 13, left sheathing tab 18, and left gusset 23 on the left side of the rafter R. The equivalent right side components of the gale clip 1 are against the right side of the rafter.

The base plate 2 is against the wall sheathing W, and fasteners are driven through nail holes 10 into the wall sheathing W. and into the underlying plates of the top plate T. Fasteners can then be driven into nail holes 11, on the rafter tabs 3 and 4, and into the rafter R. Fasteners can then be driven into nail holes 25, on the gussets 23 and 24, into the rafter R. In this building, blocking B was applied between the rafters R. Fasteners can also be driven through the nail holes 10, on the base plate 2, and into the blocking B.

The roof slope on this building is relatively shallow, but the transition bend 12, sheathing bend 15, and spacer webs 13 and 14 combine to place the sheathing tabs 16 and 17 generally parallel to the roof S and M. Underneath the roof, a hole was drilled up through the bolt holes 18 on the sheathing tabs 16 and 17. This hole was drilled up through the roof sheathing S and roof material M. A carriage bolt 30 was dropped through a square hole 32 on a roof plate 29, then down through the drilled hole in the roof, and into the bolt hole 18 on the sheathing tab 17. The same would be done on the right side. A nut 31 was threaded up and tightened. This secures the roof tightly to the wall.

The upside-down J-shape can be plainly seen. The base plate 2 and left rafter tab 3 form the vertical part of the J-shape. The transition bend 12, left spacer web 13, sheathing bend 15, left sheathing tab 17, and left gusset 23 form the curved J-shape. The right side analogous components form the right side J-shape of the gale clip 1.

With the roof S and M now connected to the top plate T and wall sheathing W, uplift from strong winds and lateral loads from earthquakes will be highly resisted. The J-shape will resist twisting of the rafter, and will resist uplift applied to either end of the rafter R. This will allow for long overhangs on buildings, which will save cooling energy and help prevent water damage to the walls and foundation of the building.

Some walls of new construction are tilted-up with wall sheathing W already attached to the wall studs D and top plate T. Gale clips 1 can be attached to the marked locations on top of the top plate T. with the cut-lines 5 and 6 generally lined up with the upper plate of the top plate T. The rafter R or roof truss R can then be slid in between the rafter tabs 3 and 4, and gussets 23 and 24 and attached with fasteners.

Sheet metal connectors have been proven to perform better than nailed connections under stresses of strong winds and earth tremors. This metal connector is very easily installed on a pre-existing house or on new construction. The rafter tabs 3 and 4 cradle the rafter R on two sides, no matter what the slope is of the roof. The rafter tabs 3 and 4 will also easily fit on rafters made up of roof trusses, engineered wood beams, or metal beams. The rafter tabs 3 and 4 are simple to attach to the rafter with nails or screws.

The base plate 2 is easily attached to the outside wall sheathing W with nails or screws. The wide rafter tabs 3 and 4, on either side of the rafter R, provide plenty of room for hammering, or using powered nail-guns, or a powered screwdriver. If the outside walls are made of brick or masonry all the way up to the rafter, holes can be marked, drilled with a carbide drill, and inserted with anchors and screws. Masonry screws can also be used to install the base plate 2.

If a soffit is located on the house, it is not structural, so it can be taken down and reinstalled after this invention is installed. Once installed, the house is much stronger than just nailed connections and more sturdy than prior art connectors that are only installed to the rafter, not the roof.

Houses with soffits often don't have blocking between the rafters. Installing this invention on these houses will help prevent the rafters or roof trusses from twisting and detaching during storms and seismic events.

The invention can be easily installed as a retrofit at what proven to be the weakest connection of a house. Loads on a house during a hurricane tend to disconnect the roof sheathing S, rafter R, outside wall sheathing W, and underlying top plate T connection. This is also a weak connection during an earthquake, as the roof is heavier than the walls and moves at a different rate which can tear the roof from the walls. This invention helps prevent, deflect, and absorb wind and seismic forces.

Use of the gale clip 1 on an existing house is simple. The gale clip 1 is inserted onto a rafter R from underneath the rafter and slid upward. The base plate 2 will be flush against the outside wall W, and the left rafter tab 3 and right rafter tab 4, will be on the appropriate sides of the rafter R.

The seat formed by the left and right horizontal cuts 5 and 6 will be flush against the bottom of the rafter R. This cradles the rafter R on three sides. Fasteners can be driven through the nail holes 11 on the left rafter tab 3 and right rafter tab 4 into opposite sides on the wide part of the rafter R.

Fasteners can be driven into the nail holes 10 of the base plate 1 through the outside sheathing W and into both plates of the top plate T. Nails or screws can also be driven into nail holes 10 on the base plate 2 into the blocking B, if it is present next to the rafter R.

If strong winds hit the house wall, shown in FIG. 3, from the right, pressure will try and push the wall W in. Many rafters R were birds-mouthed, or had a flat notch cut on the bottom which helps prevent thrusting, or having the roof weight try to push the wall outward. Only the toe-nailed connection prevented the wall from being blown in. On houses with roof trusses, only the toe-nails or prior-art connectors prevent a wall from being blown in. Now the gale clip's strong and unique connection to the roof S and M, rafter R, wall sheathing W, and top plate T will prevent the wall from moving inward.

If strong winds hit the house shown in FIG. 3 from the left, internal house pressure tries to blow the wall outward. The gale clip 1 forms an upside-down J-shape which forms a buttress, with the gussets 23 and 24, sheathing tabs 16 and 17, and spacer webs 13 an 14 forming an angled buttress stay. This prevents the top plate T and wall sheathing W from bowing out.

With the multiple connection to the rafter, at the rafter tabs 3 and 4, and at the gusset tabs 23 and 24, twisting, lifting, lateral movement, thrusting out-ward, and blowing inward are drastically reduced. This prevents the wall sheathing W and top plate T from bowing outward or detaching from the building. The positive connection to the roof sheathing S and roofing material M, on both sides of the rafter R, helps hold the roof down and can positively transfer and absorb forces acting on the roof to the walls and foundation.

Earthquakes can push a house upward and shake it side to side. The upward movement can detach the roof from the wall because it is heavier and would have more momentum. Side or lateral movement can twist or detach the rafters. The gale clip 1 prevents the rafter R from twisting, moving side-to-side, or detaching from the top plate T and outside wall W.

Another advantage shown in this side view is that nothing hangs down below the rafter R. When the gale clip 1 is painted to match the house, it will not be noticed. This appeals to homeowners and architects.

The gale clip's strong connection between the roof S and M, rafter R, outside wall W, and top plate T prevent detachment between the roof and wall during upward movement. The strong connection between the roof S and M, rafter R, wall sheathing W, and top plate T prevent twisting or detachment of rafters R and top plate T.

Figure 4:
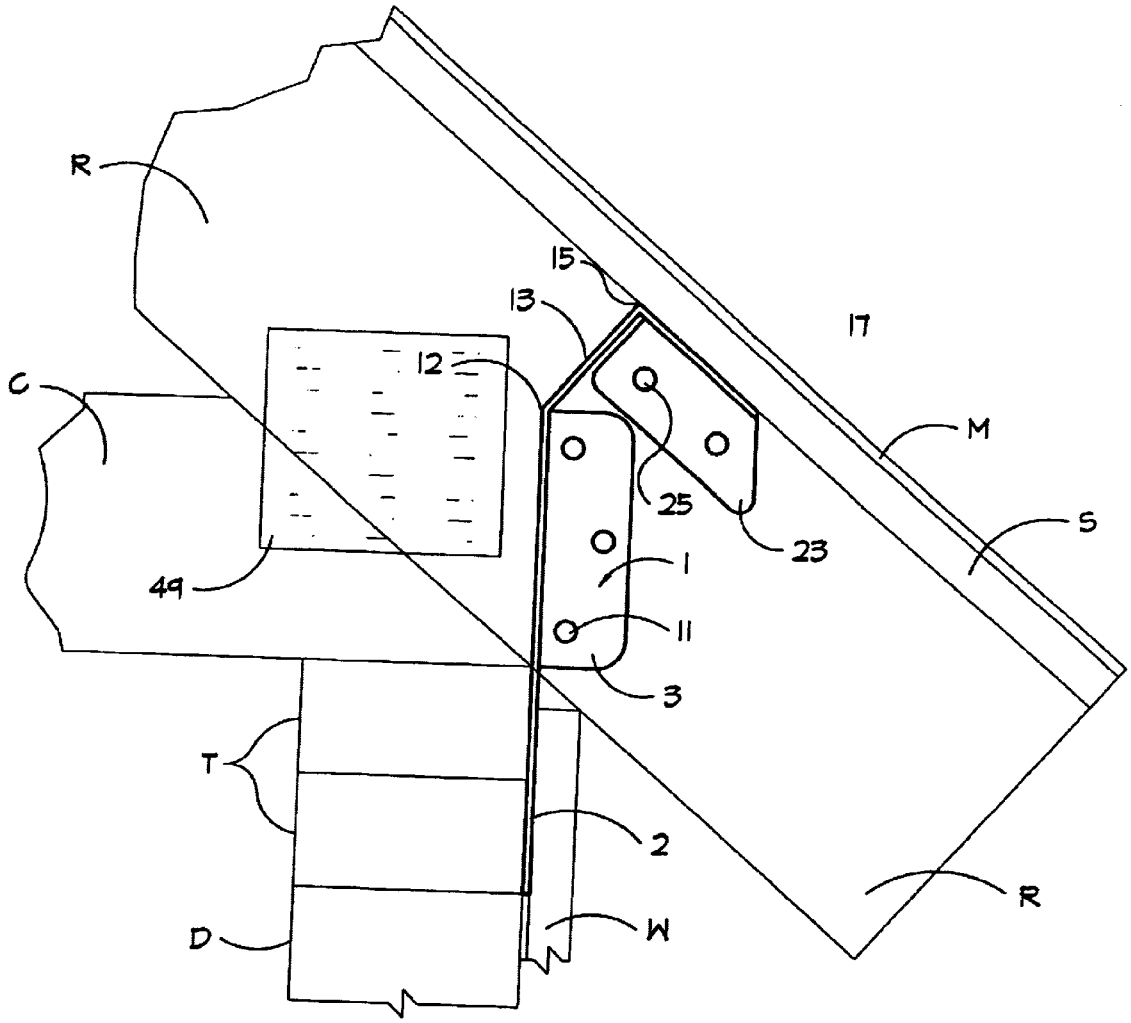
FIG. 4 is a side view of a gale clip on a house with a high-pitched roof.

Refer now to FIG. 4 which shows a gale clip 1 installed on new construction having a steeply-pitched roof truss R. The roof plate 29 is not installed to the gale clip 1, in order to show more details at the upside-down J-shape. Similar to FIG. 2, the base plate 2 has been fastened to the top plate T, and is now partly covered with wall sheathing W. The bottom chord C, of the truss R, sits on the top plate T, which sits on the wall stud D. There is no blocking attached to the roof truss R.

With the pitch of this roof much steeper then in FIG. 3 the transition bend 12, left spacer web 13, and sheathing bend 15 are able to position the left sheathing tab 17 generally parallel to the roof S and M. A hole can be drilled up through the bolt hole 18 in the sheathing tab 17 and tied to the roof R and M and roof plate 29, similar to FIG. 3. The same is done on the right side.

The strong upside-down J-shape formed by the base plate 2, rafter tab 3, spacer web 13, sheathing tab 17, and gusset 23 is still visible on steep roof pitches. The extra material, extra surface area, and extra fasteners, of the J-shape make for a stronger connection than prior art connectors without a J-shape. The base plate 2, spacer web 13, and sheathing tab 17 are perpendicular to the J-shape and provide strong resistance against lateral movement, applied perpendicular to the J-shape.

Uplift forces on the roof truss, from strong winds, would try and unbend the J-shape. But with fasteners through the nail holes 25, on each gusset 23 and 24, into the roof truss R, the fasteners would have to shear on the gussets 23 and 24 and on the rafter tabs 3 and 4 for the truss to lift.

When a roof plate 29, nuts 31, and bolts 30 are installed through the roof S and M, the roof to wall connection is further strengthened. Uplift, lateral, and thrust resistance is increased dramatically. Since the roof and wall are generally perpendicular to each other, and are now securely tied together, resistance to loads is increased tremendously.

Besides trying to lift the roof, strong winds tend to move the walls in or out, depending upon wind direction and pressure. The gale clip's strong connection to the roof, rafter, top plate, and wall sheathing help prevent the top of the wall from disconnecting or moving in and out.

Figure 5:
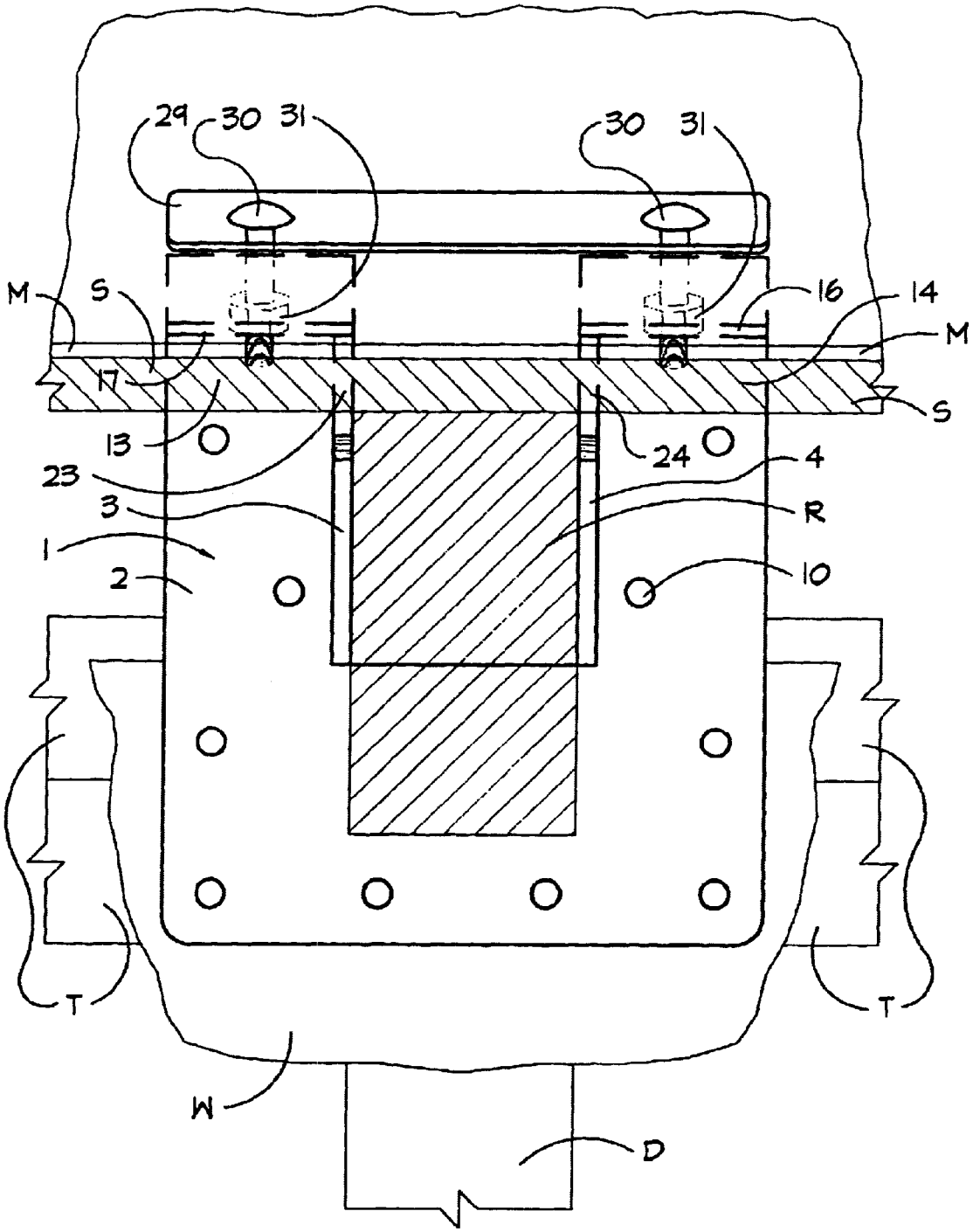
FIG. 5 is a front view of a complete installation of a gale clip.

Refer now to FIG. 5 which shows a front view of a gale clip 1 installed on a house, similar to FIG. 3. The base plate 2 is attached to the wall sheathing W and underlying top plate T by fasteners in nail holes 10. The outer edges of the wall sheathing W are cut away to reveal the underlying top plate T and wall stud D.

The rafter R is cross sectioned so it doesn't block views of the gale clip 1. The rafter is situated between, and fastened to the left rafter tab 3 and right rafter tab 4. The left gusset 23 and right gusset 24 are also fastened to the same sides of the rafter R respectively.

The roof S and M is cut away around the gale clip 1 in order to show more detail. The roof sheathing S and roofing material M is held down to the sheathing tabs 16 and 17, by bolts 30 that go through a roof plate 29, drilled holes in the roof, and bolt holes 18 in the sheathing tabs 16 and 17.

FIG. 5 shows that the gale clip 1 surrounds three sides of the rafter R, the two sides and the bottom. With the roof plate 29 attached to the roof R and M, the gale clip 1 now completely encircles the rafter R. Prior art connectors have to be bent physically around the rafter by manipulation. If a connector has to be bent in the field, odds are that it will not be bent at all or will be bent improperly. The gale clip 1 does not have to be bent around the rafter R, top plate T, or wall stud D.

It can be seen how strong the gale clip 1 makes the connection between the roof (rafter R, roofing sheathing S and roofing material M, and the wall (top plate T, wall stud D, and wall sheathing W). Prior art connectors usually only connect the rafter R, top plate T, and wall stud D. Most do not consider the sheathing as an important structural member. The roof sheathing S is the only member that gives stiffness to the roof. The wall sheathing W is the only member that gives stiffness to the wall. FIG. 5 shows the gale clip 1 tying the roof sheathing S to the wall sheathing W.

FIG. 5 shows the tremendous lateral strength of a gale clip 1. Any sideways movement applied to the wall will be highly resisted by the gale clip 1 and the roof. A lateral load applied to the wall, such as a force pushing from left to right, tends to push the top of the rafter to the left. This force is resisted due to the gale clip 1 wrapping around the rafter R, and the strong connection to the roof, which will resist, absorb, and deflect any forces applied to the rafter. Seismic forces can shake left and right repeatedly. These forces will be highly opposed.

Figure 6:
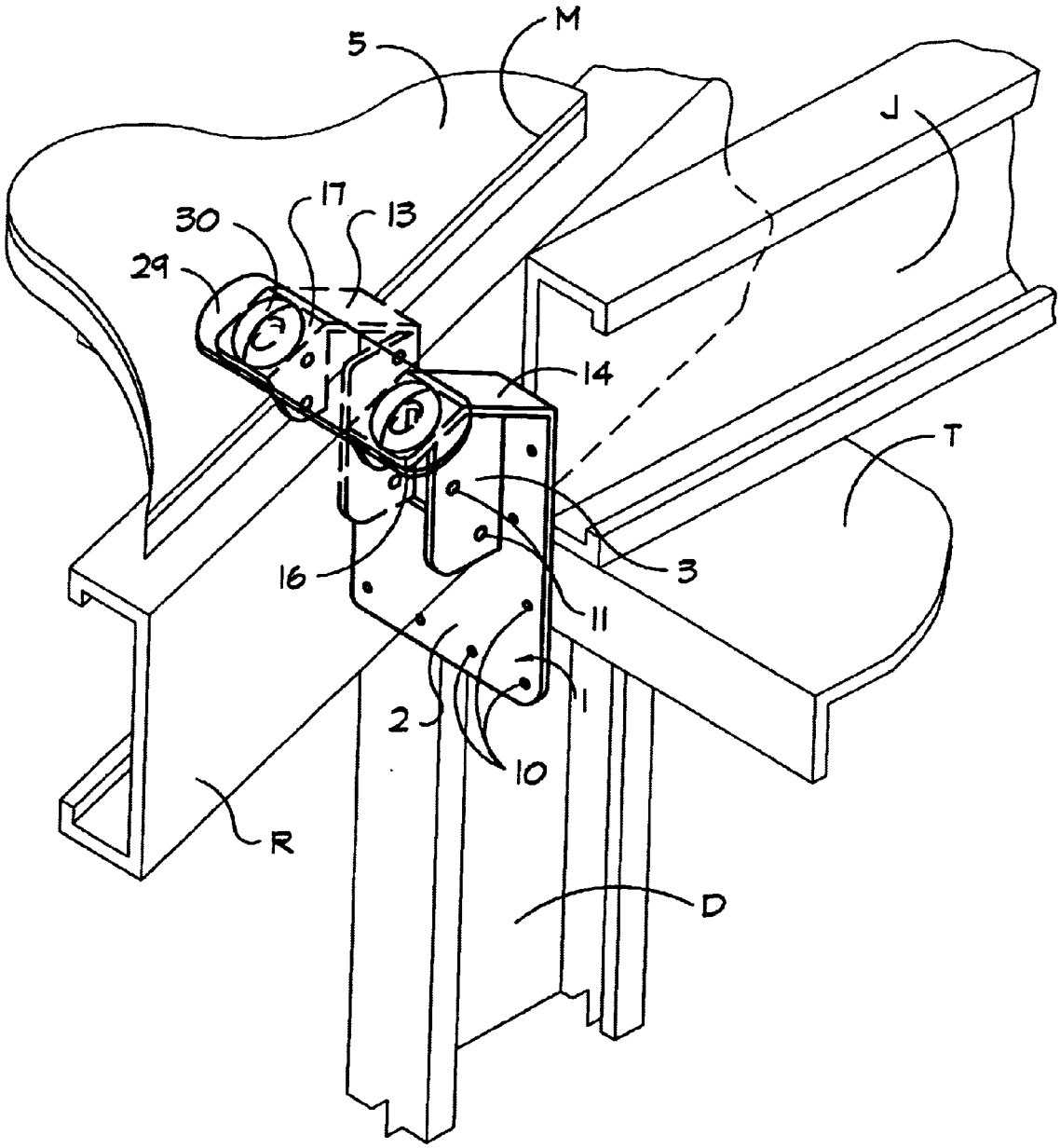
FIG. 6 is perspective view of a gale clip on light-gauge steel framing.

Refer now to FIG. 6 which shows a perspective view of a gale clip installed on light-gauge steel framing. There are several differences between wood and steel framing. The rafter is usually fastened to a joist, which is then usually fastened to the singular top plate. The wall stud is usually fastened to the singular top plate under the joist. There may not be any fasteners from the rafter directly to the top plate.

The rafter, joist, top-plate, and wall stud are usually sectional, but hollow. They can have a C-shape, U-shape, or T-shape. Roof sheathing is usually fastened to the rafter with screws. In FIG. 6, the rafter R, top plate T, and joist J are C-shape. The rafter R is fastened to the joist J. The wall stud W is fastened to the top plate T under the joist J. Roof sheathing S is fastened to the rafter R, and wall sheathing W is fastened to the wall studs D.

A gale clip 1 is shown installed to the outside wall and roof. The base plate 2 is shown attached to the outside wall sheathing W, and underlying top plate T and wall stud D. Fasteners through the nail holes 10 on the wide base plate 2 can attach to the singular top plate T because some nail holes 10 are on the mid part of the base plate 2.

On the wide base plate 2, some lower nail holes 10 will be over the wall stud D. Because the top plate T consists of only one plate, and that plate is hollow, the wall stud D will be higher up on the wall. The wall stud D should be under the joist J, but is allowed to have slight deviation to the left and right.

Fasteners that go through the nail holes 10 of the mid part of the base plate 2 will go through the outside wall sheathing W and into the singular top plate T. Other fasteners that go through the lower nail holes 10 on the base plate 2 will go into the wall sheathing W. If the wall stud D is under the joist J or under the rafter R, fasteners in nail holes 10 on the lower part of the base plate 2 will enter the wall sheathing W and wall stud D.

Fasteners through the nail holes 11 on the right rafter tab 3 will fasten to the rafter R. The sheathing tabs 16 and 17 are fastened to the roofing material M and roof sheathing S with bolts 30 through drilled holes and into the bolt holes 18 on the sheathing tabs 16 and 17.

The gale clip 1 ties together the roofing material M, roof sheathing S, rafter R, top plate T, wall sheathing W, wall stud D, and indirectly, the joist J. The roof sheathing S and rafter R are now joined directly to the wall sheathing W, top plate T, And wall stud D, where there was no direct connection before. There is now a direct connection between the wall sheathing W and wall studs D, and the rafter R and roof sheathing S. This makes a light-gauge steel frame building much stronger, and more resistant to wind and seismic forces.

Figure 6A:
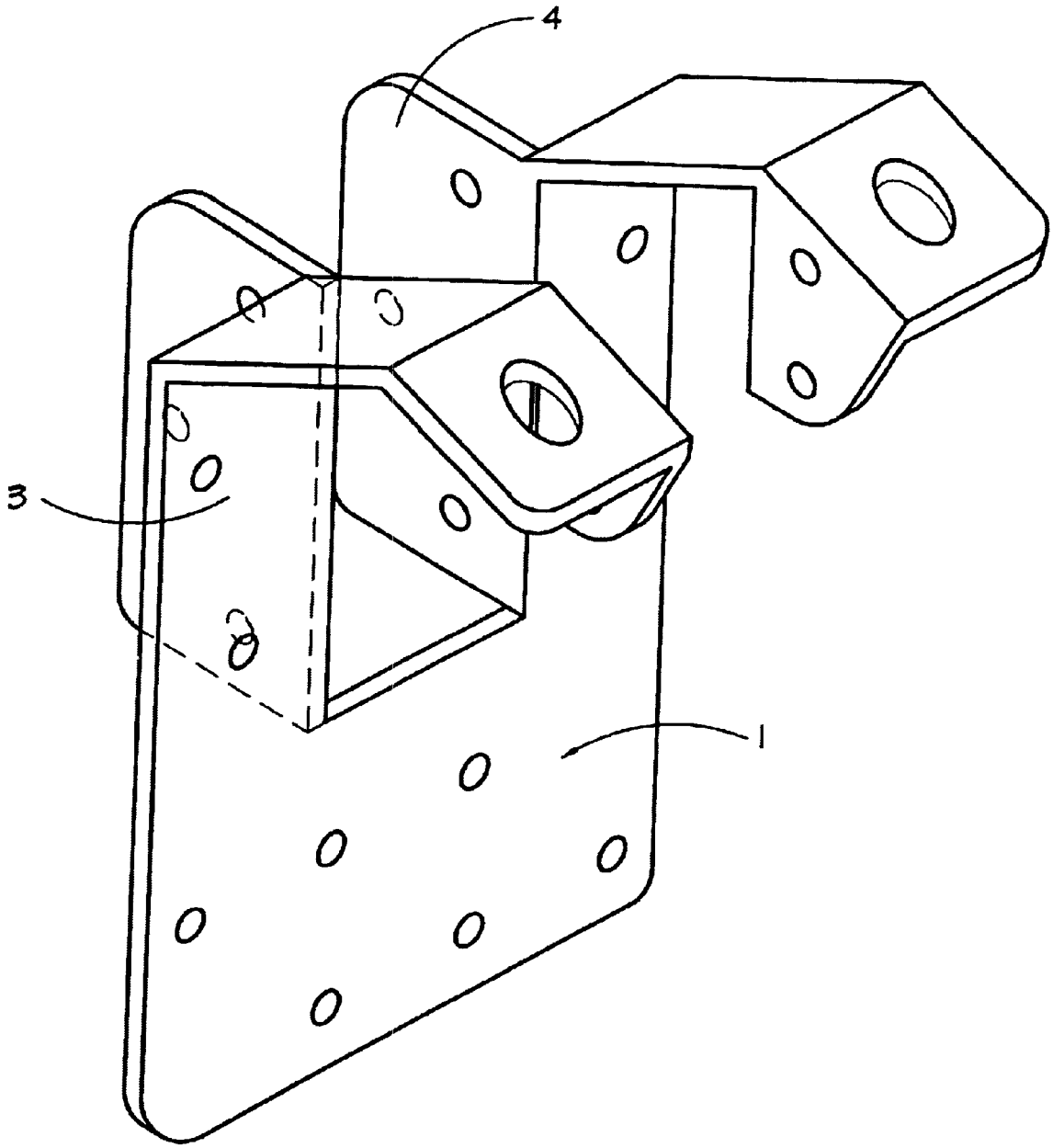
FIG. 6A is a perspective view of a modified gale clip.

Refer now to FIG. 6A which shows a modified gale clip 1. The rafter tabs 3 and 4 have been bent in to hit the joist J next to the rafter R. One rafter tab can be bent in and one can be bent out. By bending a rafter tab inward, fasteners can be attached through the nail holes 11, on the rafter tab, into the joist J. The other rafter tab can be bent forward to hit the rafter. One rafter tab can be bent back to fasten to a roof truss bottom chord, and one rafter tab can be bent forward to fasten to a roof truss rafter member. If the roof truss or rafter ends at the top plate, both rafter tabs can be bent back in order to fasten to the roof structural members.

Figure 7:
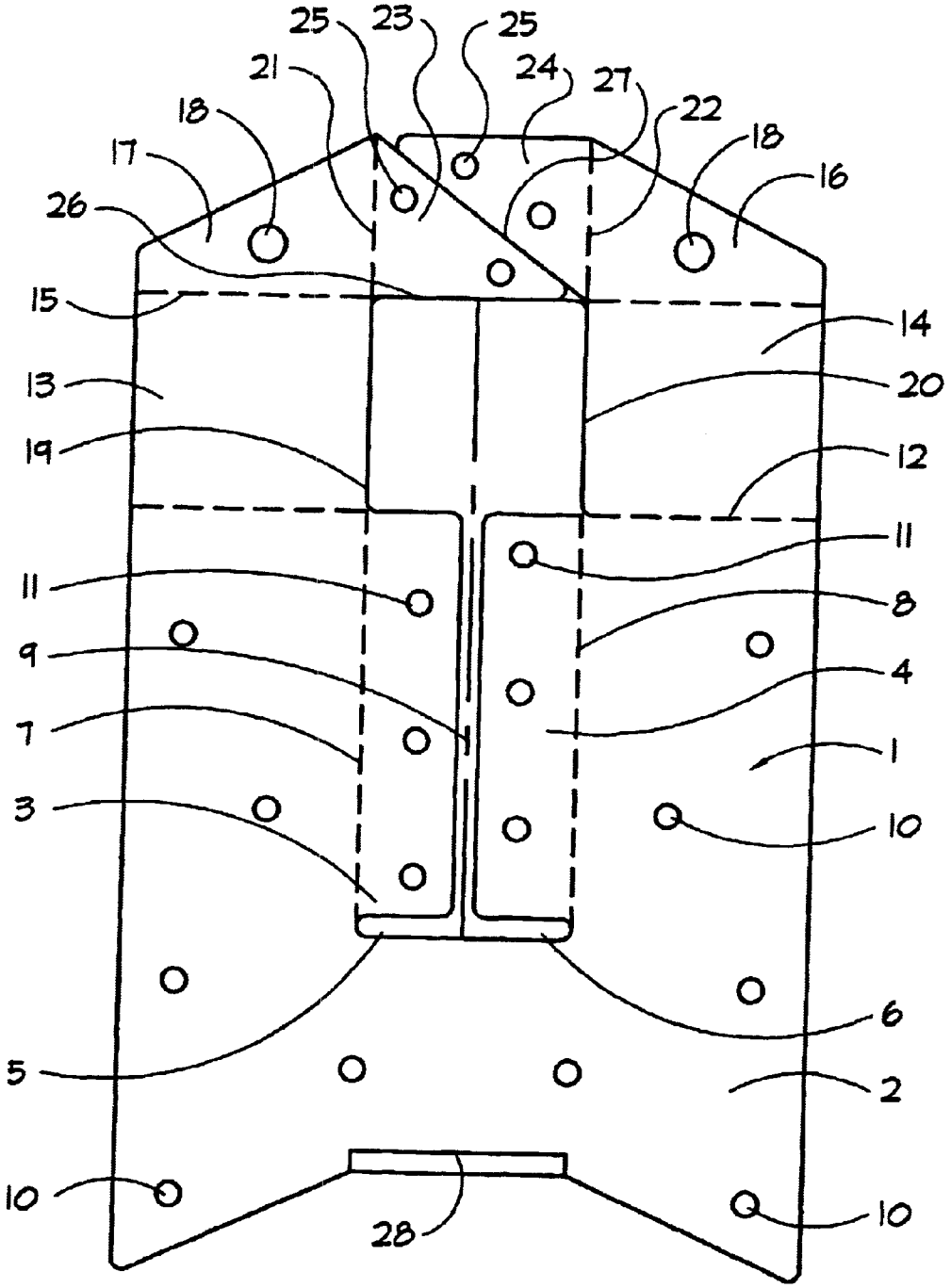
FIG. 7 is a flat pattern layout of a gale clip.

Refer now to FIG. 7 which shows a flat pattern layout of a gale clip 1. The chevron shape of the clip places more material at the sheathing tabs which tie into the roof. The base plate 2 has nail holes 10. The left rafter cut 5, right rafter cut 6, and center cut 9 form the left rafter tab 3 and right rafter tab 4. Bending on the left rafter bend 7 and right rafter bend 8 form the rafter tabs 3 and 4 with nail holes 11.

The horizontal transition bend 12, left spacer cut 19, and right spacer cut 20 form the left spacer web 13 and right spacer web 14 respectively. On top of the spacer webs 13 and 14, the sheathing bend 15 forms the left sheathing tab 17 and right sheathing tab 16 with bolt holes 18. The vertical left gusset 21, right gusset bend 22, lower gusset cut 26, and upper gusset cut 27 form the left gusset 23 and right gusset 24 with nail holes 25. Making the gale clip 1 is simple, ingenious, and wastes little material.

Figure 8:
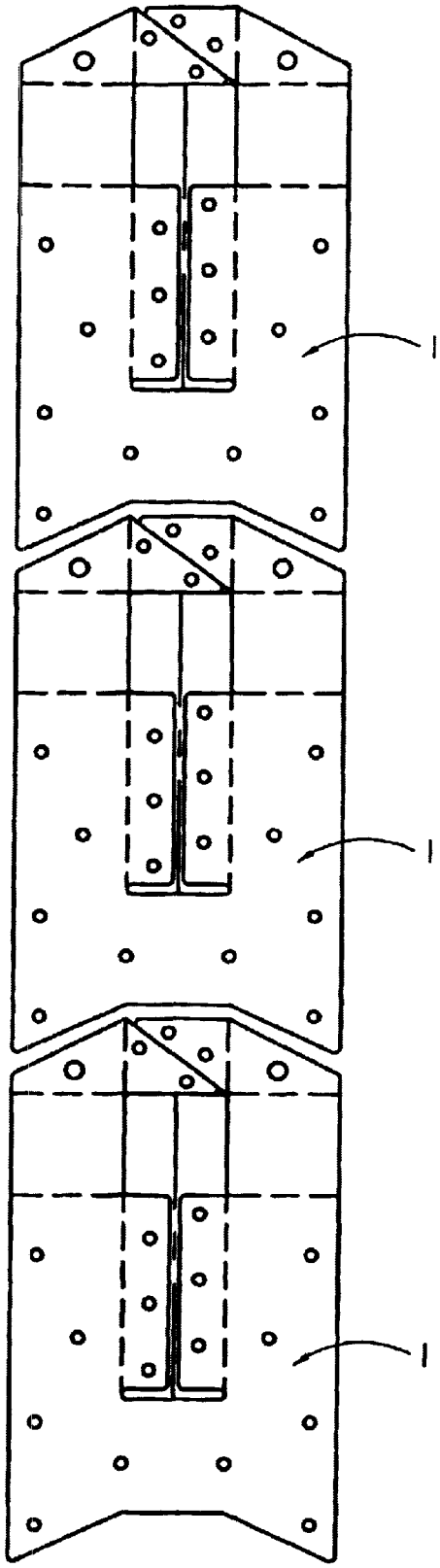
FIG. 8 is a flat pattern layout showing nesting.

Refer now to FIG. 8 which shows how the flat pattern layout for the gale clip 1 can nest with each other, thereby saving material during manufacture. This prevents waste, and saves money. The chevron shape can save material by eliminating cutting corners of the gale clip 1, which prevents small cuttings in the manufacturing site.

Figure 9:
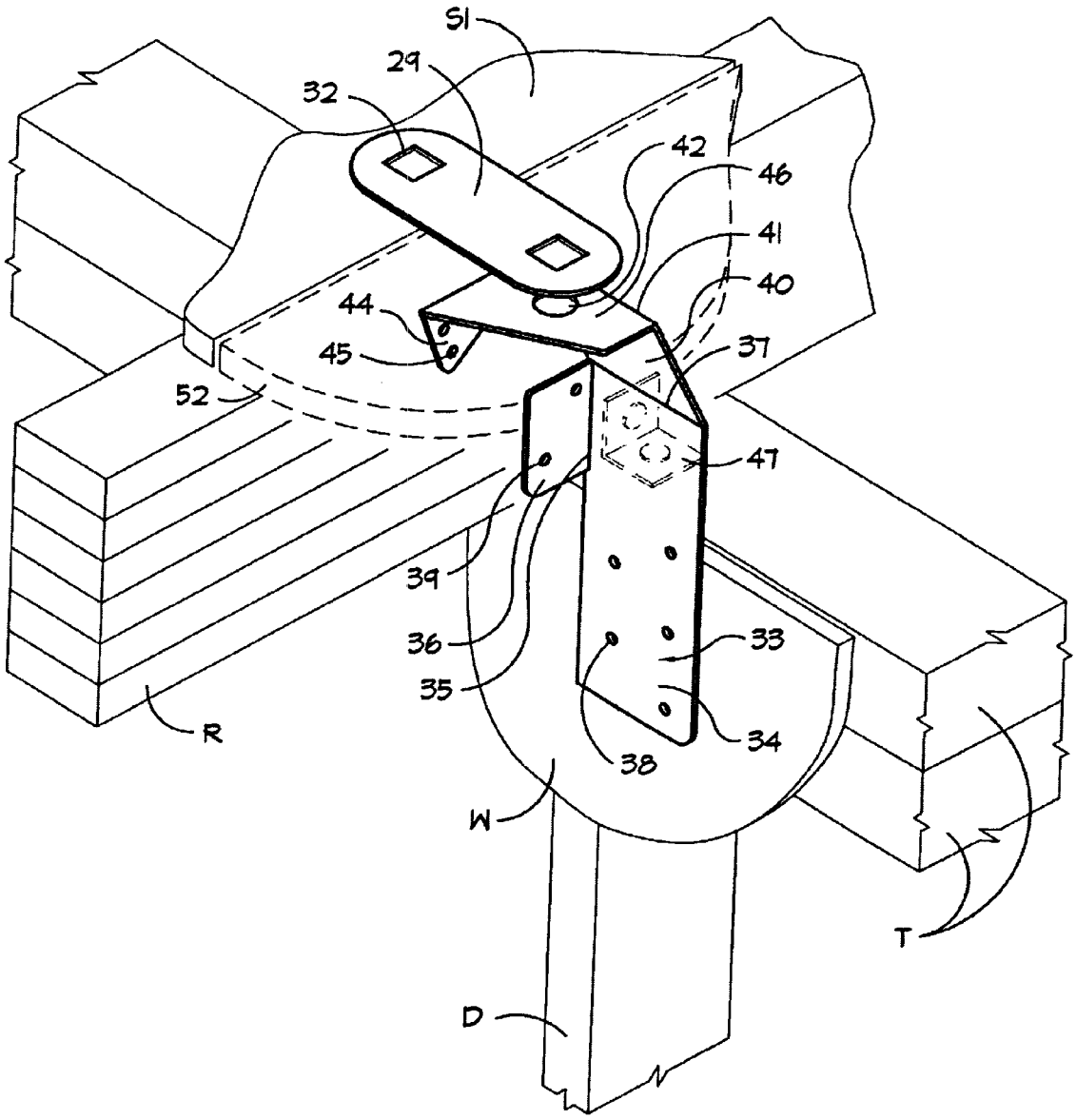
FIG. 9 is a perspective view of a squall clip installed on an odd-sized rafter.

Refer now to FIG. 9 which shows a perspective view of a right squall clip 33 mounted to the right side of a built-up rafter beam R. These beams are usually mounted to the rafter by an angle clip 47, which is prior art.

The right squall clip 33 is basically one-half of a gale clip 1. The tool and die can divide the sheet metal to form a left squall clip 33 and right squall clip 48. A left squall clip 48 is installed on the left side of the pictured rafter beam R, but is hidden by the beam.

The base plate 34 on the right squall clip 33 has fasteners attached through nail holes 38 into the outside wall sheathing W and underlying top plate T. A right-angle rafter bend 35 forms the rafter tab 36, which has fasteners through nail holes 39 into the rafter R.

An acute bend on the transition bend 37, adjacent to the rafter bend 35, forms a spacer web 40. A shallow bend on the spacer web 40, opposite the transition bend 37, forms a sheathing bend 41. The sheathing bend 41 forms a sheathing tab 46 with a bolt hole 42.

Adjacent to the sheathing bend 41, a right angle bend, called the gusset bend 43, forms a gusset 44 with nail holes 45. The gusset 44 is attached to the rafter R with fasteners through nail holes 45. This puts multiple mounting points on a single wide face of a rafter for added strength.

On top of the roof, a roof plate 29 is attached to the left sheathing tab 46 and sheathing tab of a right squall clip 48, on the hidden side of the roof beam R. The roof sheathing is attached similar to as on a gale clip 1.

FIG. 9 shows that odd size rafters can be secured to the roof and wall using a left and/or right squall clip 33 and 48.The rafter can be a recycled beam of odd or rough dimensions. It can be engineered lumber, composite lumber, hybrid lumber or have odd or metric dimensions. If a singular squall clip is installed to a rafter, such as on a gable end, a roof plate 29 with only one connection to a sheathing tab will still add great strength to the roof.

On FIG. 9, two sheets of roof sheathing meet on top of the rafter R. The roof plate 29 holds down the left sheathing sheet S1 and the right sheathing sheet S2. Both sheets of sheathing are supported from moving laterally off the thin edge of the rafter R by the tight connection to the sheathing tab 46 on the right side, and a sheathing tab on the hidden left side.

Strong attachment of the wall sheathing to the walls shape them into shear walls. The present invention securely ties the sheathing W to the wall forming a shear wall. Strong attachment of the roof sheathing S to the rafter R, top plate T, and wall sheathing W, helps turn the roof into a shear wall. No one has done this prior to this inventor.

An earthquake would try and shake the house laterally. Since the roof can move differently because it is heaver than the walls, the sheets of sheathing could ride over each other. The present invention prevents the roof sheathing S from detaching or riding over each other.

Figure 10:
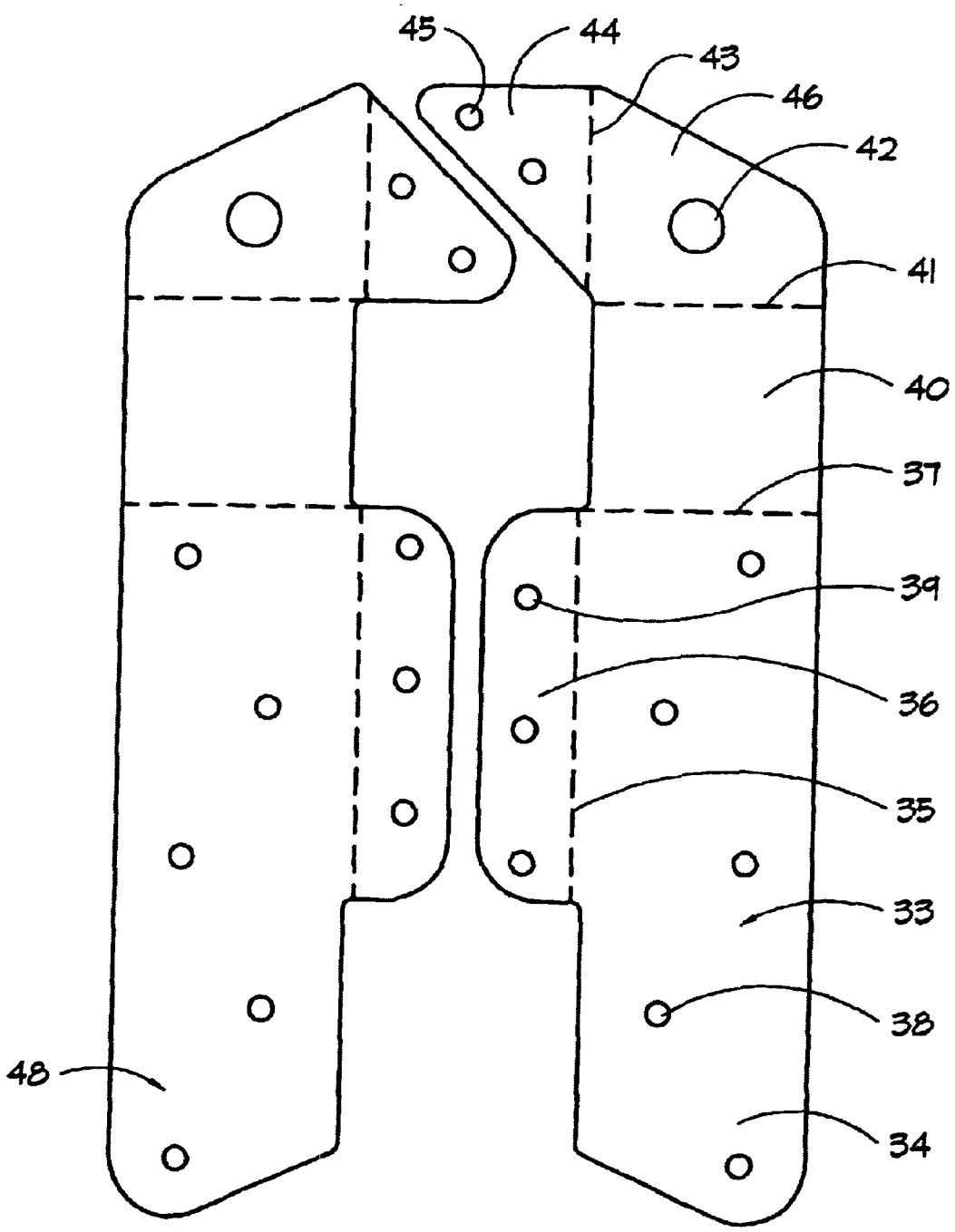
FIG. 10 is a flat pattern layout of a squall clip.

Refer now to FIG. 10 which shows a flat pattern layout of a left and right squall clip. This is approximately half of a gale clip 1. The same tool and die is used to make a left and right squall clip. Part of the base plate 2 of the gale clip 1 has been eliminated in order for easy placement of the rafter tab against odd-size rafters.

The right squall clip 33 is basically one-half of a gale clip 1. The tool and die can divide the sheet metal to form a left squall clip 33 and right squall clip 48. A left squall clip 48 is installed on the left side of the pictured rafter beam R, but is hidden by the beam.

The base plate 34 on the right squall clip 33 has nail holes 38. A right-angle rafter bend 35 forms the rafter tab 36, which has nail holes 39.

An acute bend on the transition bend 37, adjacent to the rafter bend 35, forms a spacer web 40. A shallow bend on the spacer web 40, opposite the transition bend 37, forms a sheathing bend 41. The sheathing bend 41 forms a sheathing tab 46 with a bolt hole 42.

Adjacent to the sheathing bend 41, a right angle bend, called the gusset bend 43, forms a gusset 44 with nail holes 45. The gusset 44 is bent parallel and planer to the rafter tab 36, which puts multiple mounting points on a single wide face of a rafter for added strength.

Figure 11A:
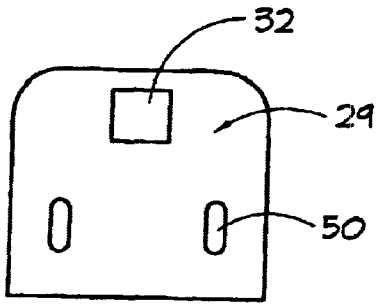
FIG. 11A is a flat pattern layout of a roof plate.

Refer now to FIG. 11A which is a flat pattern layout of a roof plate 29. The roof plate 29 has a square bolt hole 32 for holding the square end of a carriage bolt 30 which then goes through the drilled hole in a roof and into the bolt hole of a sheathing tab 16 and 17, and fastened with a nut and washer.

The roof plate 29 also has slotted holes 50, perpendicular to the flat edge. The other end has rounded edges for being along the roofing material M.

Figure 11B:
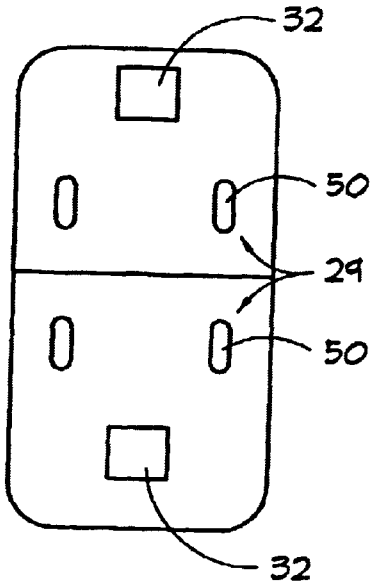
FIG. 11B is a top view of a roof plate on a double-size rafter.

Refer now to FIG. 11B which is a top view of two roof plates 29 as they would be mounted on a double-size rafter. Carriage bolts 30 go through the square bolt holes 32 and into the drilled holes in the roof and into the bolt holes of sheathing tabs, and fastened with a nut and washer. Fasteners through the slotted nail holes 50 and into the roof sheathing and rafter will give added security.

Figure 11C:
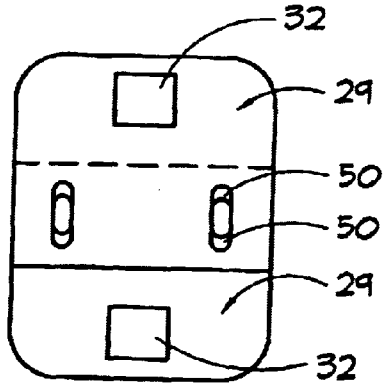
FIG. 11C is a top view of a roof plate on a standard rafter.

Refer now to FIG. 11C which is a top view of roof plates 29 mounted on a standard rafter. A standard rafter is closer together and the roof plates overlap each other. The slotted nail holes 50 overlap and fasteners can be inserted through them and into the sheathing and rafter. This provides added strength and resistance against wind and seismic forces.

The roof plate 29 can be rectangular square, or curved. A diamond-shape or a banana-shape would look pleasing from the street and will shed water when installed with the point or arch, toward the top of the house.

On top of the roof, a roof plate 29 is placed over the drilled holes with the square bolt holes 32 over the drilled holes. The square shape locks the carriage bolt 30 so it cannot turn. In this way no one has to stay on the roof and hold the bolt from turning. Carriage bolts 30 are then dropped into the holes 32 and down through the drilled hole in the roof.

Underneath the roof, the carriage bolt 30 on the left side of the rafter R has dropped through the drilled hole in the roof and passed through the bolt holes on the sheathing tabs. A nut 31 is threaded onto the threads of the carriage bolt 30 and tightened down.

The previously weak toe-nailed connection between the roof and wall is now anchored together. If hurricane winds try to lift the rafter R, or the roofing material M and roof sheathing S, the wall sheathing W and top plate T are now secured together with them, and will collectively resist multiple forces.

Another advantage is that nothing hangs down below the rafter R. When the gale clip 1 or squall clip 33 are painted to match the house, it will not be noticed. This appeals to homeowners and architects.

The clips' strong connection between the roof sheathing S, rafter R, outside wall W, and top plate T prevent detachment between the roof and wall during upward movement. The strong connection between the roof sheathing S, rafter R, and top plate T prevent twisting or detachment of rafters R and top plate T.

Many pictures of damage caused by Hurricane Andrew in 1992 show the roof sheathing missing from the leading edge of a house. This pressurized the house with wind, blowing the leeward part of the house away and letting rain ruin everything in the house. The gale clip 1 and squall clip 33 tie down the leading edge of roof sheathing preventing detachment of the roofing material M and roof sheathing S from the rafter R.

The roof plate 29 can hold down any type of roofing material M. It can hold down wood or composition shingles, metal roofs, and man-made material roofs. With a thin pad under the roof plate 39, clay tiles can be held down. Now solar panels, and satellite dishes can be secured under the roof plate 39 and safely bolted down to the roof and underlying structural members.

CONCLUSION, RAMIFICATIONS, AND SCOPE OF INVENTION

The gale clip and squall clip can be used on new construction or as retrofits that help protect a house from the effects of hurricanes, tornados, and earthquakes. Both clips hold the roof securely to the outside wall. The gale clip helps prevent a standard roof rafter or truss from lifting, twisting, moving in toward the house, moving out from the house, moving to the left, and moving to the right. The squall clip is basicall one-half of a gale clip and can be made for left or right sides of a rafter. It does the same work as a gale clip, but can work on odd-size rafters, and trusses, and both clips hold down the roofing material and roof sheathing.

The gale and squall clips also hold the outside wall sheathing securely to the wall. Both clips help prevent the outside sheathing from bowing out, bowing in, separating from the wall, riding over each other, and splitting.

Both clips turn the outside wall into a strong shear-wall and prevent the wall from racking. One tool and die can be used to make both clips with little waste of material.

Thus the reader can see that the hurricane and seismic connectors of this invention are unique, strong, permanent, functional, and necessary. They are also simple and economical to make, requiring one simple tool and die and no welding.

This invention solves the problem of retro-fitting houses to minimize high wind and seismic dangers by using an ingenious and practical connector. Many homeowners stay in their house during hurricanes, because they do not want to be caught in traffic jams trying to escape the fury, or they live on a small island. Tornados can occur at any time of day with little or no warning. If the roof can stay on a house, many tornados may be survivable.

While my above description contains many specificities, these should not be construed as limitations on the scope of the invention, but rather as an exemplification of one preferred embodiment thereof. Many other variations are possible.

For example, since the connectors are on the outside of a building, the shape can be changed slightly to make them more architecturally appealing on certain types of houses. To fit on some architectural styles of houses, the shape can be changed slightly without comprising the structural integrity of the clip. The thickness of the connector can be altered slightly, or have beveled edges or chamfer.

Rubber, plastic, foam, or resilient pads could be inserted between the connector and the outside sheathing. This would help absorb the earthquake forces without cracking, and deaden the shocks, and after-shocks.

The roof plates could have a rubber washer, O-ring, or silicone seal where it goes through the roof in order to make the connection water-proof. This will allow the tie to hold roof sheathing to the rafter, without letting water into the house. The tie could use this rubber to reduce loading and deaden shocks from a seismic event.

The roof plate is comprised of a generally flat steel plate. Since the steel plate will be exposed to the elements, it can be of stainless steel, or painted to match the roof. It can be copper-coated or made from strong plastics or man-made material. It can be textured to match shake shingles or have an s-curve shape or c-shape in order to fit the hills and valleys of a clay tile roof. It can have an arch in the middle in order to hold down solar panels or satellite dishes.

The roof plate can be rectangular square, or curved. A diamond-shape or a banana-shape would look pleasing from the street and will shed water when installed with the point or arch, toward the top of the house.

The invention could use different manufacturing techniques including manipulated sheet metal, forming, casting, forging, extrusion, and plastic molds or injection. There can also be minor variations in color, size, and materials.

This invention was over-designed in order to exceed building codes in force or any that can be anticipated. Many areas have no codes for retrofit's because, prior to this invention, there were no workable ties that could be retrofit to most buildings. Lag bolts, nails, screws, or bolts and washers could be used to fasten the connectors to the house.

I claim:

1. A connector for securing a roof to a wall of a building comprising:

a. a generally flat base member;

b. first and second generally parallel bends on said base member forming rafter tabs;

c. a third bend on said base member forming spacer webs;

d. a fourth bend on said spacer webs forming sheathing tabs;

e. fifth and sixth generally parallel bends, on said sheathing tabs, forming gussets generally planer and parallel to said rafter tabs.

2. The connector of claim 1 wherein said base member having a predetermined area and a plurality of nail holes, as a means of attachment to generally vertical structural members on a house.

3. The connector of claim 1 wherein said parallel, generally vertical rafter tabs having a predetermined distance apart, a plurality of nail holes, and a predetermined area as a means for attachment to the opposite wide sides of a structural roof member, that is generally perpendicular to said vertical structural member.

4. The connector of claim 1 wherein said third bend on said base member is generally adjacent and perpendicular to said first and second bends and is generally bent at an acute angle as a means of forming said spacer webs at an angle from said generally vertical structural member.

5. The connector of claim 1 wherein said fourth bend, opposite said third bend, having a generally shallow angle forming said sheathing tabs generally bent away from vertical.

6. The connector of claim 1 wherein said third bend and said fourth bend having shallow angles on opposite sides of said spacer webs as a means of providing deflection of said spacer webs and said sheathing tabs, thereby fashioning said sheathing tabs generally parallel to various slopes of roof pitches on buildings.

7. The connector of claim 1 wherein said sloping sheathing tabs having bolt holes and predetermined area, as a means for positive connection to said roofs using a roof plate with one or more bolt holes and predetermined area.

8. The connector of claim 1 wherein said gussets are generally parallel, planar, and spaced apart from said rafter tabs as a means of placing maximum, multiple surface areas on the wide side of said roofing structural member for added strength.

9. The connector of claim 1 wherein said base Member, rafter tabs, gussets, and shallow-angled spacer webs and sheathing tabs having predetermined area and predetermined dimensions as a means for nesting during manufacture, thereby saving material, money, and odd-shaped pieces of scrap, and making for easy attachment on new construction and as a retrofit for existing buildings.

10. A connector for securing a roof to a wall of a building comprising:

a. a generally flat base member;

b. a first bend on said base member forming a rafter tab;

c. a second bend on said base member forming a spacer web;

d. a third bend, opposite said bend on said spacer web, forming a sheathing tab;

e. a fourth bend, adjacent to said bend on said sheathing tab, forming a gusset.

11. The connector of claim 10 wherein said connector having a generally vertical division forming a left connector and right connector having generally mirror image of each other as a means for placement and attachment on roof structural members having different thicknesses.

12. The connector of claim 10 wherein said base member having a predetermined area and a plurality of nail holes, as a means of attachment to generally vertical structural members on a house.

13. The connector of claim 10 wherein said first bend on said base member having a generally right angle, forming said rafter tab perpendicular to said base plate, and said rafter having a plurality of nail holes and a predetermined area as a means for attachment to one wide side of a structural roof member on a house.

14. The connector of claim 10 wherein said second bend having a generally acute angle, a predetermined area, and adjacent to said rafter tabs, as a mean of forming said spacer web away from said generally vertical wall.

15. The connector of claim 10 wherein said third bend, on said spacer web, forming said sheathing tab at a generally shallow angle, along with said second bend, having generally parallel orientation on opposite sides of said spacer web as a means of deflection of said spacer web and said sheathing tab, thereby fashioning said sheathing tab generally parallel to various slopes of roofs on buildings.

16. The connector of claim 10 wherein said sheathing tab having a bolt hole and predetermined area, as a means for positive connection to said roofs.

17. The connector of claim 10 wherein said fourth bend having a generally right angle forming said gusset generally parallel, planar, and spaced apart from said rafter tab, as a means of placing multiple, maximum surface areas oh either side of said rafter for added strength.

* * * * *